US006282841B1

(12) United States Patent
Santa Cruz et al.

(10) Patent No.: US 6,282,841 B1
(45) Date of Patent: Sep. 4, 2001

(54) STOP DEVICE FOR SLIDING CLOSURES

(76) Inventors: Cathy D. Santa Cruz, 7630 Tholl Dr., Reno, NV (US) 89506; Edward A. Carwin, 1306 Jones St., Reno, NV (US) 89503

( * ) Notice: Subject to any disclaimer, the term of this patent is extended or adjusted under 35 U.S.C. 154(b) by 0 days.

(21) Appl. No.: 09/517,947

(22) Filed: Mar. 3, 2000

(51) Int. Cl.[7] ..... F05F 3/00; F05C 19/18

(52) U.S. Cl. ..... 49/449; 49/404; 49/450; 49/451; 292/259 R; 292/289

(58) Field of Search ..... 49/449, 450, 451, 49/404; 292/DIG. 46, 259 R, 275, 289, 296, 339

(56) References Cited

U.S. PATENT DOCUMENTS

| | | | | |
|---|---|---|---|---|
| 122,655 | * | 1/1872 | Rockwood | 292/259 R |
| 164,701 | * | 6/1875 | Willis | 292/275 |
| 808,410 | * | 12/1905 | Tripp | 292/259 R |
| 1,659,898 | * | 2/1928 | Simpson | 292/275 |
| 2,205,677 | * | 6/1940 | Tracy | 292/275 |
| 3,471,189 | * | 10/1969 | Ness | 292/266 |
| 3,486,781 | * | 12/1969 | Crum | 292/262 |
| 3,816,967 | * | 6/1974 | Littrell | 49/449 |
| 4,059,141 | * | 11/1977 | Hutton | 160/90 |
| 4,135,376 | * | 1/1979 | Evans et al. | 70/100 |
| 4,208,841 | * | 6/1980 | Starks | 49/449 |
| 4,429,911 | * | 2/1984 | O'Neal et al. | 292/259 R |
| 4,593,492 | * | 6/1986 | Lumenello | 49/57 |
| 4,846,513 | * | 7/1989 | Mathis | 292/262 |
| 4,927,203 | * | 5/1990 | Mayer et al. | 292/201 |
| 5,102,173 | * | 4/1992 | Schallern | 292/288 |
| 5,313,739 | * | 5/1994 | Nelson et al. | 49/404 |
| 5,447,346 | * | 9/1995 | Virzi | 292/289 |
| 5,595,410 | * | 1/1997 | Wilson et al. | 292/306 |
| 5,971,450 | * | 10/1999 | Suarez | 292/289 |

FOREIGN PATENT DOCUMENTS

| | | | |
|---|---|---|---|
| 30838 | * | 4/1933 | (DK) . |
| 19991 | * | 8/1891 | (GB) . |
| 20056 | * | 6/1905 | (GB) . |
| 125047 | * | 5/1949 | (SE) . |

* cited by examiner

*Primary Examiner*—Gregory J. Strimbu

(57) ABSTRACT

A stop device that is used to prevent unauthorized opening of sliding closures, such as windows and doors, which is esthetically pleasing, is adjustable in length and includes removable decorative accessory items. The stop device includes first and second elongated extension members and a locking mechanism. The locking mechanism includes first and second levers which engage the first and second members, respectively, to lock the first and second members with respect to the locking mechanism.

7 Claims, 3 Drawing Sheets

STOP DEVICE FOR SLIDING CLOSURES

FIELD OF THE INVENTION

This invention relates to stop devices used on sliding closures, such as windows, sliding glass doors, etc., and is used to prevent unauthorized opening thereof. However, the device more particularly relates to an adjustable decorative stop device that is most aesthetically pleasing, is very strong, includes a unique locking mechanism, and may also include various removable accessory items of user choice.

BACKGROUND OF THE INVENTION

It is well known in the field that sliding closures such as windows, glass doors, etc., are used to not only prevent unauthorized entry into an otherwise enclosed room, but are most often used to provide ventilation and vary room temperature as well. Therefore, many times the user will only slightly open the window or door so as to allow air to circulate, unfortunately this provides easy entry for burglars, or other criminals, thus this is can be very dangerous.

Therefore, within the prior art many attempts have been taught to overcome the above problem, however each have inherent drawbacks and disadvantages which the present invention not only recognizes, but addresses and resolves in a manner heretofore not taught.

The most pertinent related prior art is taught within our co-pending application Ser. No. 09/229,507, entitled "STOP DEVICE FOR SLIDING CLOSURES" which has now been issued as U.S. Pat. No. 6,167,655. Wherein we provide a stop device that is very pleasing to the eye but the applicants have since found the device to have certain inherent disadvantages which the present invention overcomes. Such as the device is not as strong as it appears and in use is not quite as efficient as anticipated. For example, the locking mechanism as taught therein can be easily broken and the adjustment means for varying the length is much too limited. Thus, numerous sizes must be manufactured for various sized closures and this is therefore not cost effective.

However it is to be noted the present invention also includes some of the unique features of the noted application but the actual structure is completely different. For example, the present invention still incorporates use of various removable decorative accessory items, the device may be used as a piggy-bank, it may include a night-light, etc.

Another example of known prior art is U.S. Pat. No. 5,102,173 entitled "REENFORCER FOR DOORS AND WINDOWS". Wherein they provide a telescopic device that is formed from multiple slidably engaged members. With each of the members being locked into a position of user choice by pins which protrude from holes when adjusted into place. This device is somewhat functional for its intended use but it is not esthetically pleasing, it is limited to locked positions according to placement of the pins, and includes parts which the present invention eliminates. Furthermore, the applicants contend this device would not be nearly strong enough to prevent opening of the closure, because due to the telescopic design each of the members are hollow, thus greatly reducing strength. Also, the only locking mechanism is the pins that can easily break when force is applied to the device.

A further example of known prior art is U.S. Pat. No. 44,208,841, wherein they provide a "stop assembly and system for sliding closures" comprising an assembly in the shape of a wedge, with the wedge being attached to the window by at least one VELCRO strip. Whereby, when the closure is partially opened into a position of choice, the wedge becomes lodged substantially between the window and frame, thus preventing further opening of the window from the outside. This device is functional for its intended use, however this assembly is limited in use as the user must first determine where to attach the VELCRO strip, attach the wedge, and open the window until the wedge becomes lodged into place. Thus, the window can become damaged when the wedge is forced into position, and also if the user wishes to vary the distance the window can open, the VELCRO must be removed which can be difficult, or the user must attach multiple VELCRO strips, which is bothersome.

Yet another prior art reference is U.S. Pat. No. 4,135,376 which teaches a "patio door security bar with lock" wherein they provide an elongated bar which is installed within the window framework with multiple screws and sliding bolts, etc. This device is again functional for its intended use but is much too complicated, most unsightly when installed, and includes many parts, etc.

Further pertinent prior art references include U.S. Pat. Nos. 4,429,911, 4,059,141, and 4,593,492, each of which attempt to provide a means to lock or secure a closure member in a fixed position. However, each reference is extremely complicated, they are much too costly and difficult to install, and none include the unique and novel features of the present invention as will be seen within the following specification.

SUMMARY OF THE INVENTION

In accordance with the present invention we provide a stop device for sliding closures which inhibits opening of the sliding closure and is a deterrent for unauthorized entry there through.

It is accordingly a principle object of the present invention to provide a stop device comprising a first and a second elongated member having a side-by-side relationship, with each being slidably contained within a housing and slidably adjustably engaged within a locking mechanism.

Also another object of the present invention is to provide a stop device wherein the above noted locking mechanism is manually finger actuated levers or the like.

A further object of the present invention is to provide a stop device which is of a shape and size to be easily inserted within or removed from either a sliding glass door frame or window frame, etc., respectively.

It is another object of the present invention to provide a stop device which includes means to be adjustably variable in length which allows the user to partially open the closure at a position of choice.

Yet another object of the present invention is to provide a stop device which will not mar or damage the sliding closure in any way, as no installation tools are required, and no screws, bolts, etc., are used to secure the stop device into position.

A further object of the present invention is to provide a stop device which is of simple construction, and which can be made from substantially any desirable material of engineering choice, such as steel or the like.

Still a further object of the present invention is to provide a stop device which is lightweight and easily carried by an adult or a child.

Also, another very important object of the present invention to provide a stop device which is aesthetically pleasing and can be seen from either side of the closure.

A further object of the present invention is to provide a stop device which may include interchangeable decorative accessory attachments, such as a crystal ball, a comical figure, or even a holiday related attachment like a Christmas tree, etc. such as taught within the noted co-pending application.

Yet another object of the present invention is to provide a stop device which may include a battery operated night light, which is again taught within the noted co-pending application.

Still another object of the present invention is to provide a stop device which may be coated with a fluorescent material, or each accessory item may be fluorescent so as to glow in the dark, as suggested in the noted co-pending application.

Also another object of the present invention is to provide a stop device which is universal and can be installed within typical sliding glass doors, windows which are horizontally aligned, or windows which are vertically aligned, respectively.

Yet another object of the present invention is to provide a stop device which may include a magnet for increased stability and for removably securing the stop device when installed into the desired position.

Still a further object of the present invention is to provide a stop device which requires minimal bending over to install, as the stop device includes an upwardly extending support member which easily functions as a handle and is positionable at any location of user choice.

Another object of the present invention is to provide a stop device which may also serve as a piggy-bank if so desired which is also inherent within the noted co-pending application.

Yet another object of the present invention is to provide a stop device and a unique method of use.

Other objects and advantages will be seen when taken into consideration with the following specification and drawings.

DETAILED DESCRIPTION OF THE DRAWINGS

Referring now in detail to the drawings wherein like characters refer to like elements throughout the various views.

Figure 1:
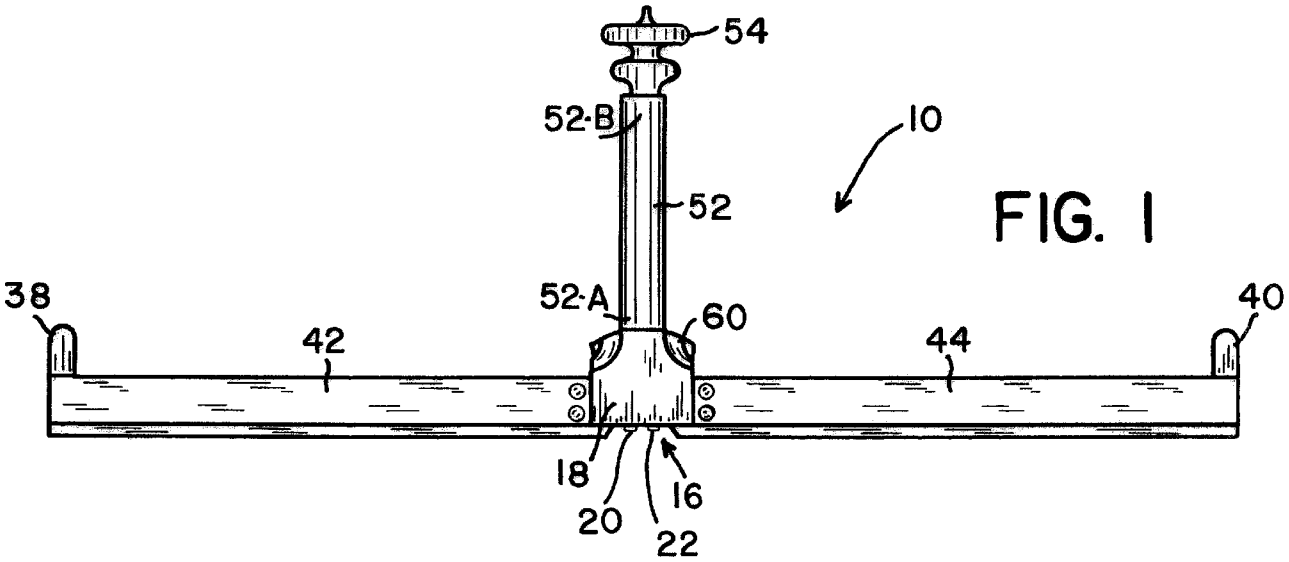
FIG. 1 is substantially a frontal view of the preferred embodiment of the present invention.
Figure 2:
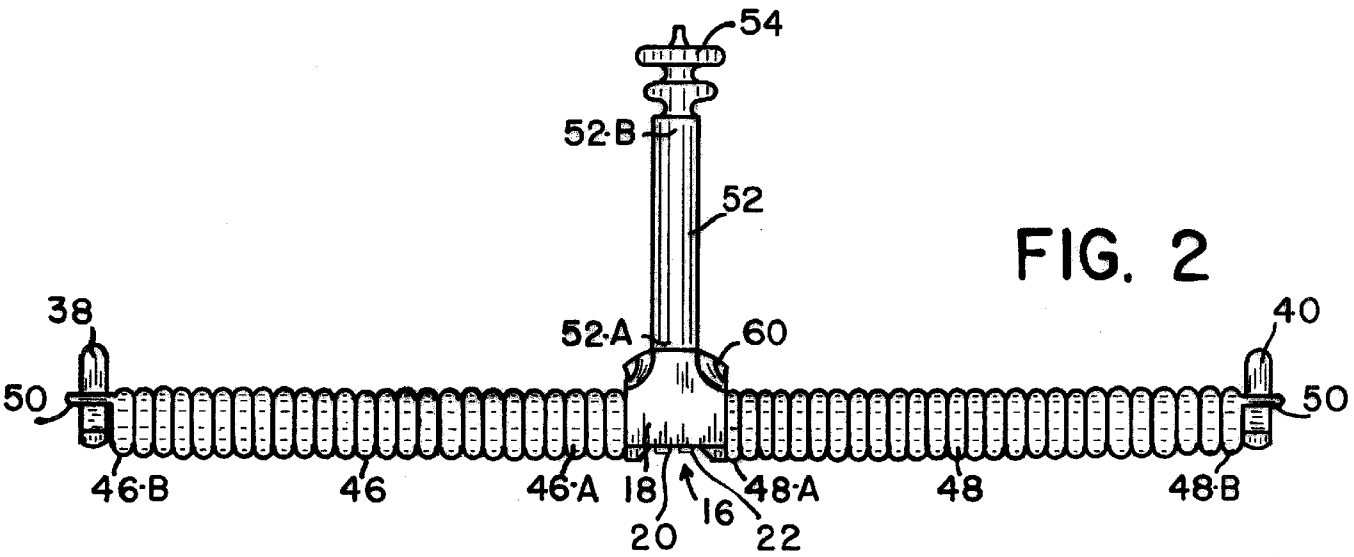
FIG. 2 is substantially a frontal view of a second embodiment of the present invention.

As shown in FIGS. 1 & 2, 10 represents an overview of the present invention which is substantially a new and unique stop device for a sliding closure. It is to be understood that substantially any sliding closure having a sliding panel movable with respect to a frame is suitable for use with the present invention.

For example, the closure may be a typical pair of sliding glass doors or windows that are either substantially vertically or horizontally aligned, etc.

Referring now to FIGS. 3–6, wherein the stop device is shown having a first elongated extension member (12), a second elongated extension member (14), and a locking mechanism (16) having a locked position and an unlocked position. It is to be understood members (12 & 14) and locking mechanism (16) can be made from substantially any suitable material of engineering choice, such as steel, plastic, etc. Also members (12 & 14) can be of any suitable length of engineering choice, such as 2'4" or the like. Or members (12 & 14) can be manufactured and sold in various lengths which are designed specifically for closures having predetermined measurements.

Figure 3:
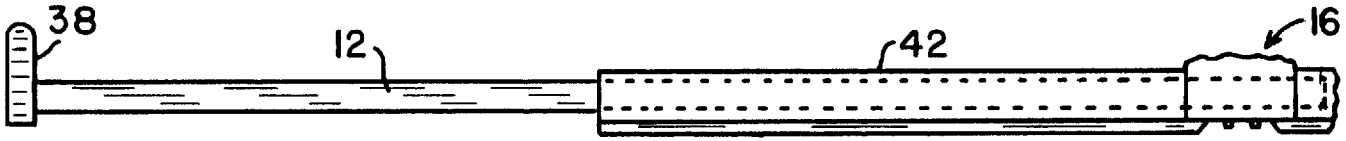
FIG. 3 is substantially a partial frontal view showing a first position for a first elongated extension member.
Figure 6:
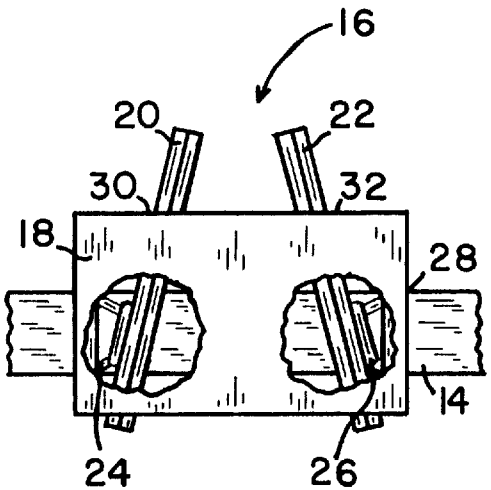
FIG. 6 is substantially a partial frontal view of the locking mechanism when in an unlocked position.

First elongated extension member (12) being slidably movable between a fully extended first position (as illustrated in FIG. 3) and a second non-extended position (as illustrated in FIGS. 1 & 2) when locking mechanism (16) assumes an unlocked position (as illustrated in FIG. 6).

Figure 4:
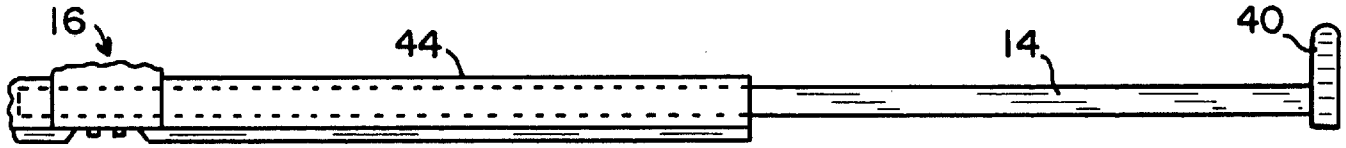
FIG. 4 is substantially a partial frontal view showing a first position for a second elongated extension member.

While second elongated extension member (14) being slidably movable between a fully extended first position (as illustrated in FIG. 4) and a second non-extended position (as illustrated in FIGS. 1 & 2) when locking mechanism (16) assumes an unlocked position (as illustrated in FIG. 6). With the fully extended first position of first elongated extension member (12) being substantially opposed to the fully extended first position of second elongated extension member (14). While first elongated extension member (12) and second elongated extension member (14) are substantially aligned parallel to each other when in the second position, and each member (12 & 14) is fixedly engaged within locking mechanism (16) when locking mechanism (16) assumes the locked position. Therefore, stop device 10 is clearly adjustably variable in length. This allows the stop device to be functional with substantially any type of sliding closure of user choice.

Furthermore, this allows the user to easily insert the stop device within the sliding closure and adjust the length so as to restrict opening of the closure. Or the user may adjust the stop device so as to allow the closure to be only partially opened, for ventilation purposes or the like.

Figure 5:
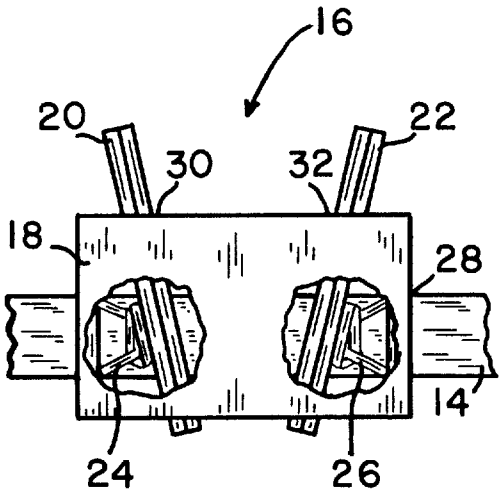
FIG. 5 is substantially a partial frontal view of the locking mechanism when in a locked position.

It is to be further noted locking mechanism (16) can be substantially any suitable locking mechanism of engineering choice. However, the preferred embodiment is depicted in FIGS. 5 &. 6, wherein locking mechanism (16) includes a locked position such as illustrated in FIG. 5, and an unlocked position such as illustrated in FIG. 6. Locking mechanism (16) substantially includes a housing (18), a first lever (20), a second lever (22), a first pair of springs (24) and a second pair of springs (26).

Housing (18) having a central cavity (28) there-through which is of a shape and size to slidably receive each member (12 & 14) therethrough. Housing (18) further having a first aperture (30) for receiving first lever (20) therethrough and a second aperture (32) for receiving second lever (22) therethrough. It is to be understood housing (18) can be made from substantially any suitable material of engineering choice, such as steel, aluminum, plastic etc. and is of any suitable size of choice, such as 2½ by 1½ inches or the like.

Figure 8:
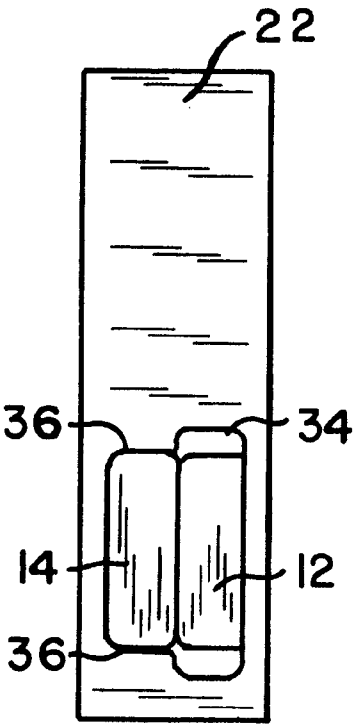
FIG. 8 is substantially a frontal view of a second Lever.
Figure 7:
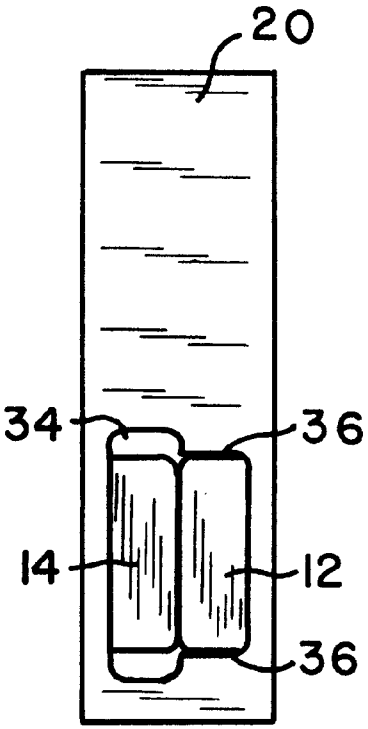
FIG. 7 is substantially a frontal view of a first lever.

Referring now to FIGS. 7 & 8 wherein we show each of the levers (20 & 22) having a central cavity (34) there through which is of a size and shape to slidably receive each of the members (12 & 14) therethrough. First lever (20) being of a length to extend from within housing (18) outwardly from first aperture (30) and second lever (22) being of a length to extend from within housing (18) outwardly from second aperture (32). It is to be understood that each of the levers (20 & 22) can be used singularly or in combination as depicted. Also, cavity (34) can be uniform in shape so as to mate and conform to the shape of each member (12 & 14). Or as the applicants prefer, cavity (34) can be formed having teeth (36).

It is to be further understood each of the levers (20 & 22) are of any suitable size of engineering choice such as 2½ inches by 1 inch, or the like and can be made from any suitable material such as steel. However, in practice the applicants have found that low carbonized steel is most efficient, strong and durable.

Referring now to the springs (24 & 26) as depicted in FIGS. 5 & 6 wherein we show the first pair of springs (24) being in communication with first lever (20) and the second pair of springs (26) being in communication with second lever (22). It is to be understood any suitable type of springs may be used according to engineering choice and each may be made from any suitable material of choice, such as spring steel, or the like.

As illustrated within FIG. 5, when locking mechanism (16) is in a locked position first pair of springs (24) applies tensional force against first lever (20). Which in turn forces first lever (20) to engage member (12) and restrict movement of member (12). And second pair of springs (26) applies tensional force against second lever (22) which in turn forces second lever (22) to engage member (14) and restrict movement of member (14).

It is to be understood the stop device is fully functional with only the locking mechanism (16) in combination with members (12 & 14). However the applicants contend that such a stop device is not exactly esthetically pleasing. Therefore, the stop device further includes the following components which when included provide a very pleasing appearance and provides unusual results which allow the user to interchange accessory items in a unique manner.

As depicted in FIGS. 1–4, stop device further includes a first and a second handle (38 & 40) with the first handle (38) being fixedly attached onto a first end of first elongated extension member (12). While the second handle (40) is fixedly attached onto a first end of second elongated extension member (14). This allows either extension member (12 & 14) to be easily moved into the desired location when the locking mechanism (16) is in its unlocked position. It is to be understood any suitable type of handle can be used, but it is preferred that each handle be made from a material such as rubber, which will not mar the sliding closure in any manner.

For further esthetic purposes, stop device (10) may include each of the members (12 & 14) being concealed within a first and a second cover (42 & 44) when each member (12 & 14) is in their second position, as depicted in FIG. 1. It is to be understood any suitable cover of engineering choice may be used such as a plastic cover, or the like.

In FIG. 2, we show stop device (10) having a variation of a cover including a first sleeve (46) having a first end (46-A) and a second end (46-B), and a second sleeve (48) having a first end (48-A) and a second end (48-B). Each sleeve (46 & 48) being formed from an elongated rubberized accordion shaped segment. First sleeve (46) having attachment means for fixedly attaching first end (46-A) of first sleeve (46) onto locking mechanism (16) and second end (46-B) of first sleeve (46) having attachment means for fixedly attaching second end (46-B) onto first handle (38). With second sleeve (48) having attachment means for fixedly attaching first end (48-A) of second sleeve (48) onto locking mechanism (16) and second end (48-B) of second sleeve (48) having attachment means for fixedly attaching second end (48-B) onto second handle (40).

It is to be noted any suitable type of attachment means may be used for attaching first end (46-A) of first sleeve (46) onto locking mechanism (16) and first end (48-A) of second sleeve (48) onto locking mechanism (16), such as glue or the like.

It is to be further noted any suitable type of attachment means may be used for attaching second end (46-B) of first sleeve (46) onto first handle (38) and second end (48-B) of second sleeve (48) onto second handle (40), such as a loop (50) or the like.

For further esthetic purposes and novelty, stop device (10) further includes a central upright support member (52) and an accessory item (54). It is to be noted either central upright support member (52) or accessory item (54) can be made from any suitable material of choice, such as plastic, wood, or the like. Also, accessory item (54) can be substantially in the form of any item of user choice, such as it may be in the form of a holiday ornament, a world globe, an animal figure, etc. This provides novelty as this allows the user to easily change the accessory item according to their wishes. Furthermore, central upright support member (52) may function as a piggy-bank which is unique as well. Still further it can be seen when stop device (10) incorporates central upright support member (52) in combination with accessory item (54), a viewer standing on either side of the sliding closer can easily see the accessory item to be displayed, which is most pleasing.

Figure 9:
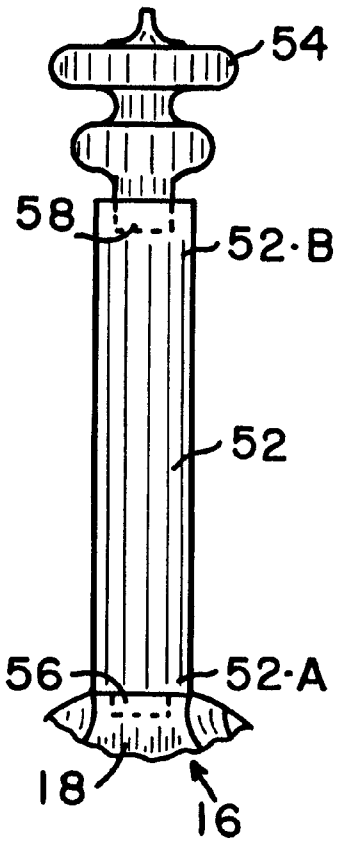
FIG. 9 is substantially a partial frontal view showing a central upright support member having an accessory item thereon.

Central upright support member (52) includes a bottom end (52-A) and a top end (52-B) with bottom end (52-A) having attachment means for fixedly attaching central upright support member (52) to locking mechanism (16). For example, locking mechanism (16) may include a protrusion (56), as illustrated in ghost lines in FIG. 9, which is of a shape and size to be frictionally engaged within bottom end (52-A), or other attachment means may be used.

Top end (52-B) further includes attachment means of engineering choice for removably affixing central upright support member (52) onto accessory item (54). For example, accessory item (54) may include a protrusion (58), as illustrated in ghost lines in FIG. 9, which is of a shape and size to be frictionally engaged within top end (52-B).

For further esthetic purposes each of the levers (20 & 22) may include buttons (60) of engineering choice, such as in the form of rubber covers or the like, which are of a shape and size to be easily grasped by the user.

It will now be seen we have herein provided a new and unique stop device for sliding closures which does not require any tools, screws, bolts, etc. for installation of the present invention and will not mar or damage the closure in any manner.

It will further be seen we have herein provided a stop device which is adjustable in length, is esthetically pleasing and includes removable accessory items.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and wish to secure by LETTERS PATENT is:

1. A stop device, for use with a closure having a sliding panel movable with respect to a frame, comprising: a first elongated extension member; a second elongated extension member; and a locking mechanism; said locking mechanism having a locked position and an unlocked position, said first elongated extension member being slidably movable between a fully extended first position and a non-extended second position when said locking mechanism assumes said unlocked position, said second elongated extension member being slidably movable between a fully extended first position and a non-extended second position when said locking mechanism assumes said unlocked position, said first position of said first elongated extension member being opposed to said first position of said second elongated extension member, said first elongated extension member and said second elongated extension member being parallel to each other, each said member being fixedly engaged within said locking mechanism when said locking mechanism assumes said locked position, said locking mechanism comprising: a housing; a first lever; a second lever; a first pair of springs; and a second pair of springs; said housing having a central cavity therethrough which slidably receives said members therethrough, said housing having a first aperture for receiving said first lever therethrough, said housing having a second aperture for receiving said second lever therethrough, each said lever having a central cavity therethrough which slidably receives said members therethrough, said first lever being of a length to extend from within said housing outwardly from said first aperture, said second lever being of a length to extend from within said housing outwardly from said second aperture, said first pair of springs being in contact with said first lever, and said second pair of springs being in contact with said second lever, wherein:

when said locking mechanism is in said locked position, said first pair of springs applies tensional force against said first lever to force said first lever into contact with said first member and restricts movement of said first member, and said second pair of springs applies tensional force against said second lever to force said second lever into contact with said second member and restricts movement of said second member.

2. The stop device of claim 1, further includes a first sleeve having a first end and a second end; and a second sleeve having a first end and a second end, said first sleeve comprising an elongated rubberized accordion shaped segment, said first end of said first sleeve having attachment means for fixedly attaching said first end of said first sleeve onto said locking mechanism, said second end of said first sleeve having attachment means for fixedly attaching said second end of said first sleeve onto a first handle, said second sleeve comprising an elongated rubberized accordion shaped segment, said first end of said second sleeve having attachment means for fixedly attaching said first end of said second sleeve onto said locking mechanism, and said second end of said second sleeve having attachment means for fixedly attaching said second end of said second sleeve onto a second handle.

3. The stop device of claim 2 wherein said attachment means for fixedly attaching said first end of said first sleeve onto said locking mechanism and said attachment means for fixedly attaching said first end of said second sleeve onto said locking mechanism are glue.

4. The stop device of claim 2 wherein said attachment means for fixedly attaching said second end of said first sleeve onto said first handle is a loop, and said attachment means for fixedly attaching said second end of said second sleeve onto said second handle is a loop.

5. The stop device of claim 1 further includes a central upright support member and an accessory item; said central upright support member having a bottom end and a top end, said bottom end having attachment means for fixedly attaching said central upright support member to said locking mechanism, and said top end having attachment means for removably affixing said central upright support member to said accessory item.

6. The stop device of claim 5 wherein said attachment means for fixedly attaching said central upright support member to said locking mechanism comprises a protrusion extending from said locking mechanism which is of a shape and size to be frictionally engaged within said bottom end.

7. The stop device of claim 5 wherein said attachment means for removably affixing said central upright support member to said accessory item comprises a protrusion extending from said accessory item which is of a shape and size to be frictionally engaged within said top end.

* * * * *